US006264282B1

(12) United States Patent
Gaumont

(10) Patent No.: US 6,264,282 B1
(45) Date of Patent: Jul. 24, 2001

(54) BLADE HOLDER FOR FLOOR STRIPPING MACHINE AND A FLOOR STRIPPING MACHINE

(76) Inventor: Claude Gaumont, #26, 21431 TWP Rd. 522, Sherwood Park, Alberta (CA), T8E 1G1

( * ) Notice: Subject to any disclaimer, the term of this patent is extended or adjusted under 35 U.S.C. 154(b) by 0 days.

(21) Appl. No.: 09/351,926

(22) Filed: Jul. 12, 1999

(51) Int. Cl.[7] ..... A47L 13/08

(52) U.S. Cl. ..... 299/36.1; 15/236.01

(58) Field of Search ..... 299/36.1, 37.1, 299/37.2, 103; 30/329, 330, 331; 24/489, 498, 515; 15/93.1, 236.01, 236.05, 236.06, 236.07, 236.08

(56) References Cited

U.S. PATENT DOCUMENTS

| | | | | |
|---|---|---|---|---|
| 1,293,751 | * | 2/1919 | Garrison | 451/457 |
| 2,715,770 | * | 8/1955 | Meyer | 30/330 |
| 4,053,958 | | 10/1977 | Taylor | 15/93 |
| 4,365,843 | | 12/1982 | Grasse | 299/37 |
| 4,504,093 | | 3/1985 | Grasse | 299/37 |
| 4,575,936 | * | 3/1986 | Gringer | 30/169 |
| 5,002,629 | | 3/1991 | Nakamura | 156/584 |
| 5,037,160 | | 8/1991 | Ukai | 299/37 |
| 5,082,330 | | 1/1992 | Holder | 299/37 |
| 5,197,784 | | 3/1993 | Holder | 299/37 |
| 5,409,299 | | 4/1995 | Holder | 299/41 |
| 5,641,206 | | 6/1997 | Craft | 299/37.1 |
| 5,772,284 | | 6/1998 | Lindsey et al. | 299/36.1 |

OTHER PUBLICATIONS

Crain Cutter Co., Inc. 1998 Catalog, 40 pages.

* cited by examiner

*Primary Examiner*—David Bagnell
*Assistant Examiner*—John Kreck
(74) *Attorney, Agent, or Firm*—Christensen O'Connor Johnson Kindness PLLC

(57) ABSTRACT

A blade holder for a floor stripping machine and a floor stripping machine equipped with such a blade holder. The blade holder includes a first member and a second member. The first member has a blade positioning seat. The second member is movable toward the blade positioning seat to a blade clamping position and away from the blade positioning seat to a blade release position, thereby permitting insertion or removable of a scraping blade. A hydraulic actuator is provided for moving the second member into the blade clamping position.

6 Claims, 4 Drawing Sheets

BLADE HOLDER FOR FLOOR STRIPPING MACHINE AND A FLOOR STRIPPING MACHINE

FIELD OF THE INVENTION

The present invention relates to a blade holder for a floor stripping machine and a floor stripping machine having such a blade holder.

BACKGROUND OF THE INVENTION

Floor stripping machines (such as described in U.S. Pat. Nos. 4,504,093; 5,002,629; 5,037,160; 5,082,330; 5,197,784; 5,772,284) are used to strip carpet, tile and other floor coverings from floors. They generally use a scraping blade with a maximum length of 27 inches, so that the blade can pass through a standard doorway (28 inches). Sufficient pressure per square inch must be exerted upon the scraping blade in order to remove the floor covering. The pressure requirements vary with the type of floor covering and its mode of attachment. For example, with ceramic tile that is attached to a floor with adhesive, it is often necessary to go to a small blade in order to achieve sufficient pressure per square inch upon the scraping blade.

When the floor stripping machines are in operation, the scraping blades must frequently be replaced due to wear. In addition, when smaller blades are being used to increase the blade pressure per square inch, the positioning of the scraping blade must be adjusted between a central position and an offset position in which the scraping blade is offset to the left or right. The central position is used in open areas. The offset position is used near walls or obstructions.

The scraping blades are generally secured by bolts to a blade mounting assembly on the floor stripping machines. U.S. Pat. No. 4,365,843, filed by Grasse, illustrates and describes such a blade holder. The blade mounting assembly of the Grasse reference has a blade mounting head with outwardly projecting flanges. The scraping blade is clamped by fasteners between a blade holder plate and the flanges. While the blade mounting assembly of Grasse holds the scraping blade securely it is time consuming to replace or change the position of the scraping blade.

SUMMARY OF THE INVENTION

What is required is a blade holder for a floor stripping machine that enables rapid replacement or positional adjustment of the scraping blade.

According to a first aspect of the present invention there is provided a blade holder for a floor stripping machine includes a first member and a second member. The first member has a blade positioning seat. The second member is movable toward the blade positioning seat to a blade clamping position and away from the blade positioning seat to a blade release position, thereby permitting insertion or removal of a scraping blade. Means is provided for urging the second member into the blade clamping position.

With the blade holder, as described above, the scraping blade is rapidly changed by moving the second member away from the blade positioning seat of the first member. This must be a controlled movement. Beneficial results have been obtained when the second member is pivotally mounted to the first member and the movement is a pivotal movement.

There are various means by which the second member may be moved relative to the first member. Beneficial results have been obtained through the use of telescopic actuators that operate on fluid pressure.

According to another aspect of the present invention, there is provided a floor stripping machine which includes a body having a first end and a second end, and ground engaging wheels supporting the body at the first end. A blade holder, as described above is positioned at the second end of the body.

Although beneficial results may be obtained through the use of a blade holder that has a fixed position, it is preferred that the blade holder be movable between a travel position and an operative position. Even more beneficial results may, therefore, be obtained when the first member is mounted by a pivotal mounting bracket to the second end of the body. This enables the first member to be pivotally moved between a raised travel position and a lowered operative position. It is preferred that the first member is moved between the travel position and the operative position by means of a second actuator that telescopically expands and contracts in response to fluid pressure.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
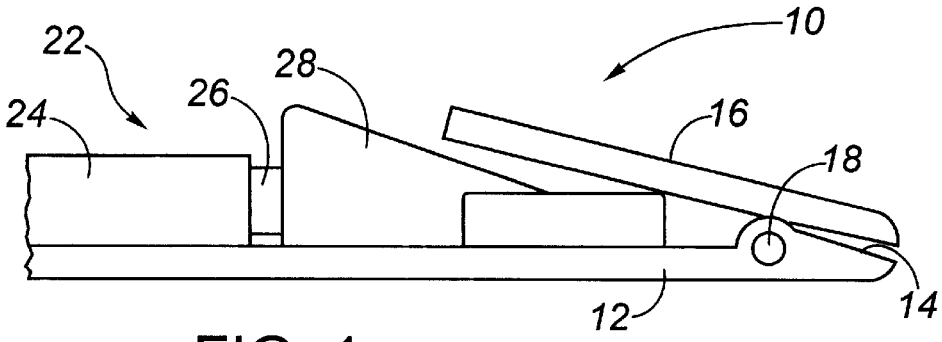
FIG. 1 is a side elevation view of a blade holder constructed in accordance with the teachings of the present invention with the second member in the blade releasing position.

The preferred embodiment, a blade holder for a floor stripping machine, generally identified by reference numeral 10, will now be described with reference to FIGS. 1 through 7.

Figure 2:
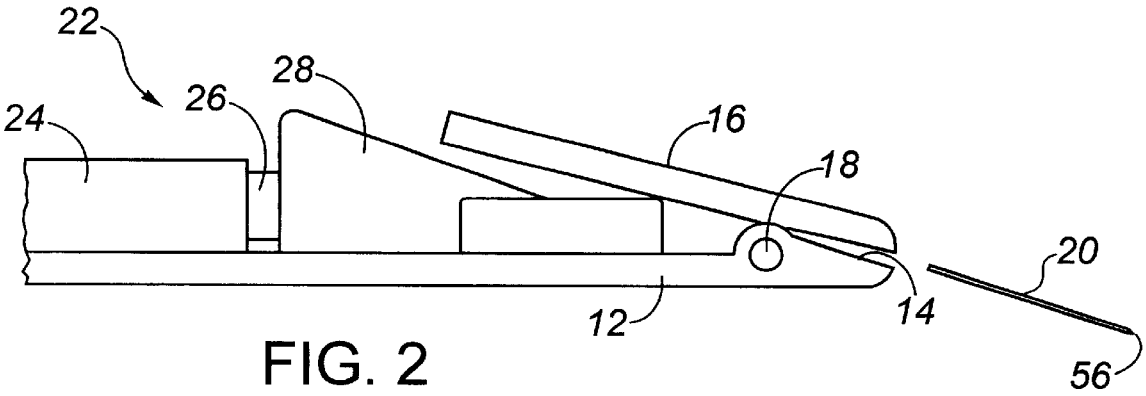
FIG. 2 is a side elevation view of the blade holder illustrated in FIG. 1, with a scraping blade in the process of being inserted.
Figure 3:
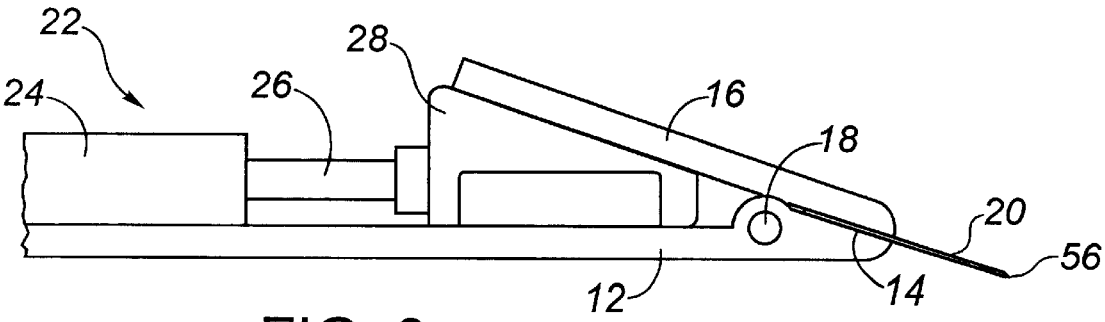
FIG. 3 is a side elevation view of the blade holder illustrated in FIG. 1, with the scraping blade inserted and the second member in the blade clamping position.

Referring to FIG. 1, blade holder 10, for a floor stripping machine, comprises a first member 12 having a blade positioning seat 14 and a second member 16 pivotally secured to first member 12 at a position 18. Referring to FIGS. 1 through 3, second member 16 is pivotally movable toward blade positioning seat 14 to a blade clamping position as illustrated in FIG. 3, and away from the blade positioning seat 14 to a blade release position as illustrated in FIGS. 1 and 2, thereby permitting insertion or removal of a scraping blade 20 as illustrated in FIG. 2.

Figure 4:
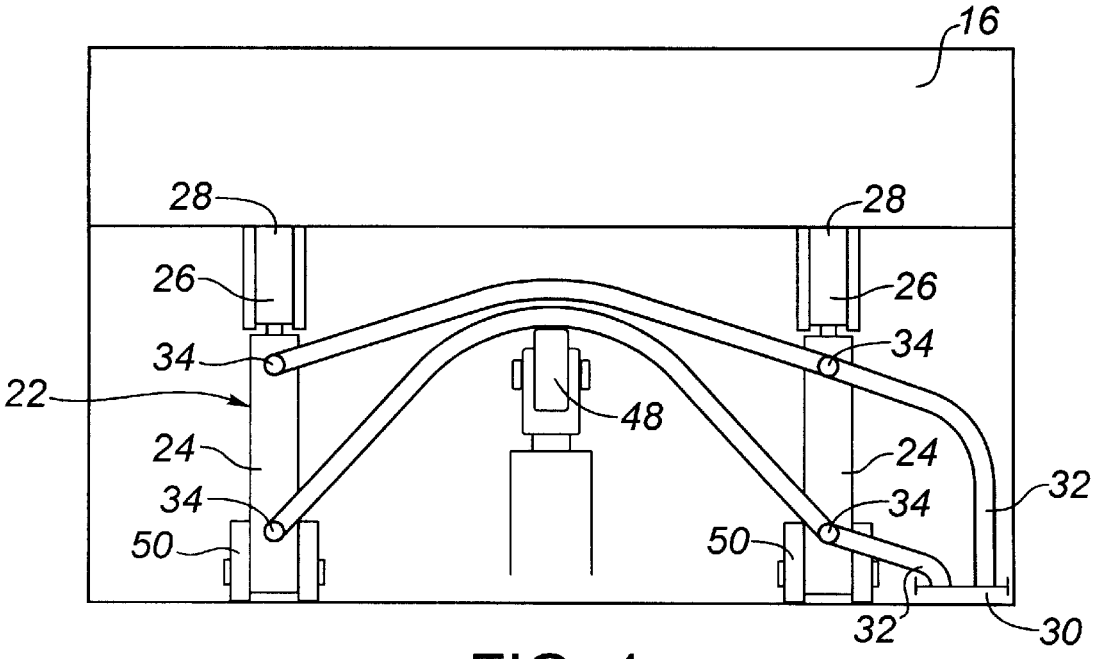
FIG. 4 is a top plan view of the blade holder illustrated in FIG. 1.
Figure 5:
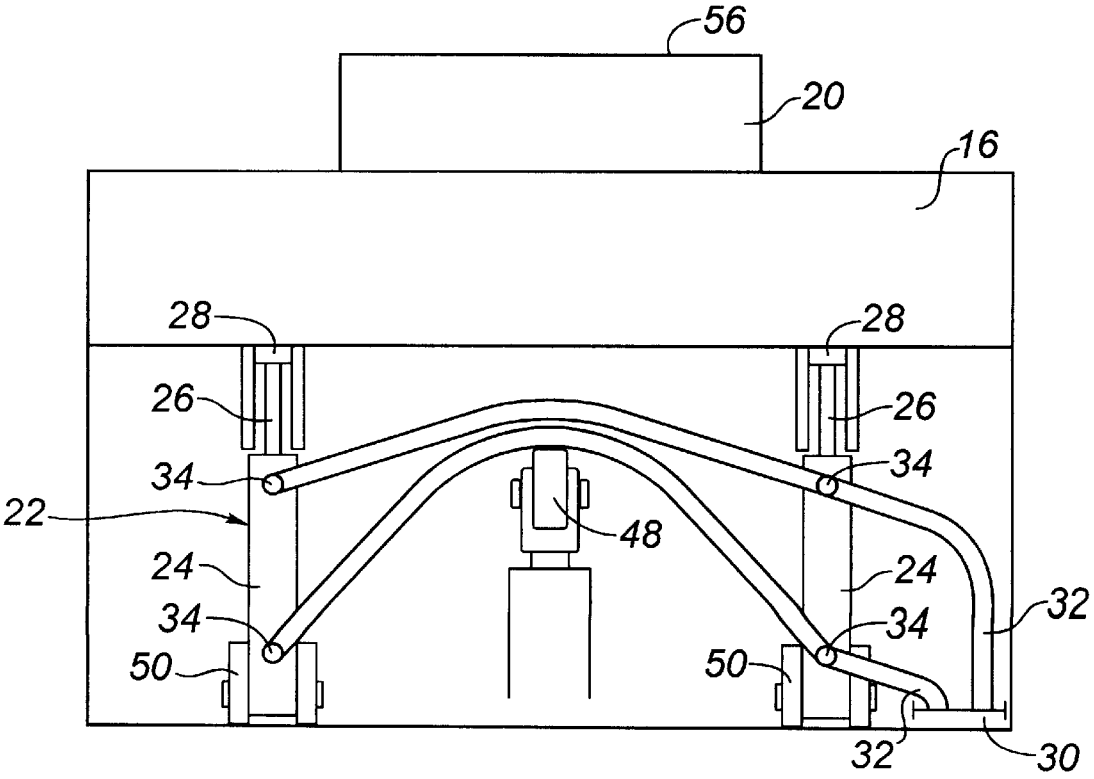
FIG. 5 is a top plan view of the blade holder with scraping blade illustrated in FIG. 3.

Referring to FIGS. 1 through 5, a first telescopic hydraulic actuator 22 is provided for moving second member 16 between the blade clamping position illustrated in FIGS. 3 and 5, and the blade releasing position illustrated in FIGS.

1, 2 and 4. First actuator 22 comprises a hydraulic mechanism housing 24, a piston 26 and a wedge shaped head 28. Referring to FIGS. 4 and 5, hydraulic fluid is pumped from a fluid reservoir 30 to expand first actuator 22, and returned to fluid reservoir 30 to contract first actuator 22, via a pair of fluid lines 32. Fluid lines 32 supply fluid to and remove fluid from each of two first actuators 22 at positions 34. Referring to FIG. 3, when first actuator 22 telescopically expands in response to pressure from hydraulic fluid, head 28 urges second member 16 to pivotally move into the blade clamping position. Referring to FIGS. 1 and 2, when first actuator 22 is contracted the pressure exerted by head 28 upon second member 16 is released, allowing second member 16 to pivotally move to the blade release position.

Figure 6:
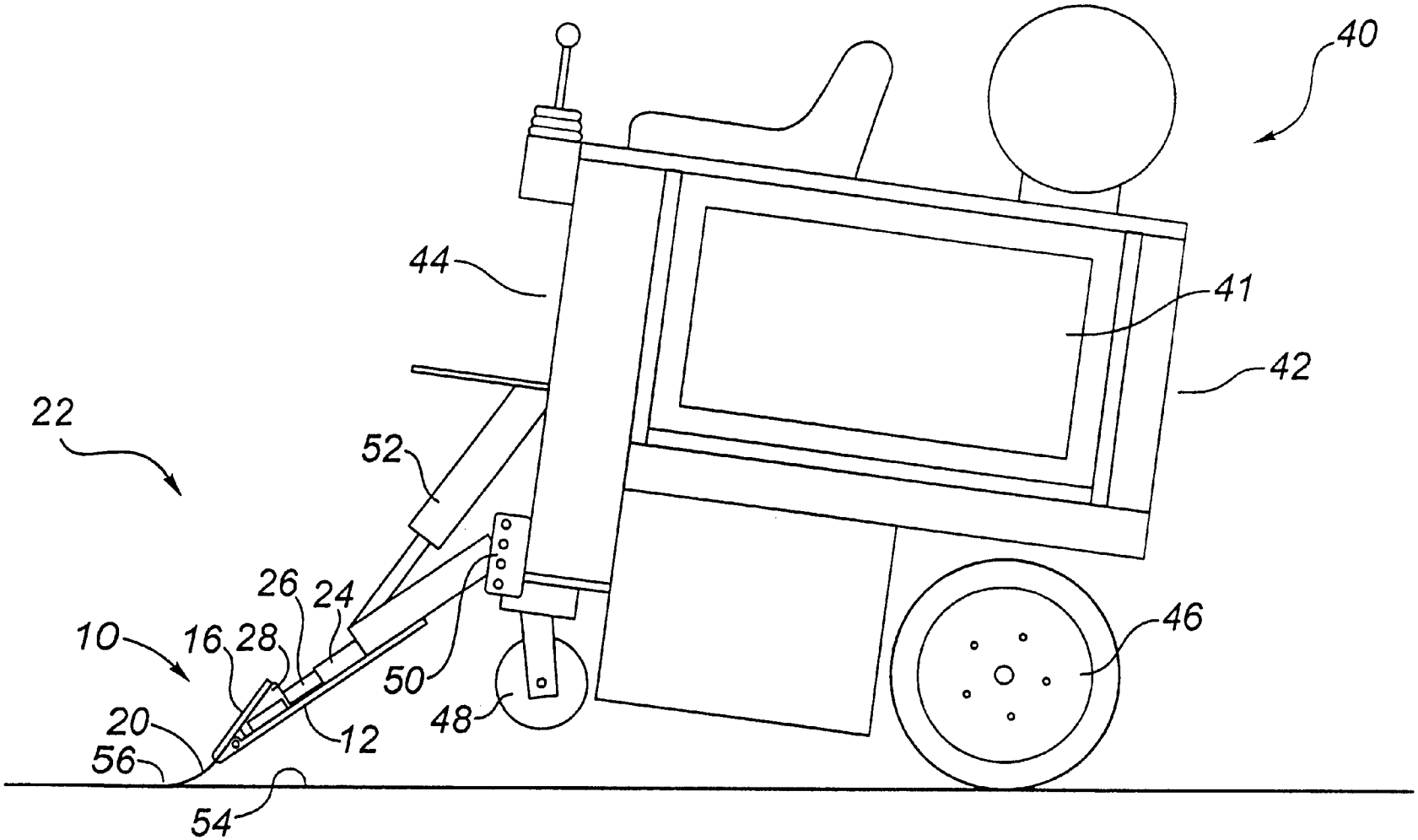
FIG. 6 is a side elevation view of a floor scraping machine equipped with the blade holder illustrated in FIG. 1, the blade holder being in a lowered operative position.
Figure 7:
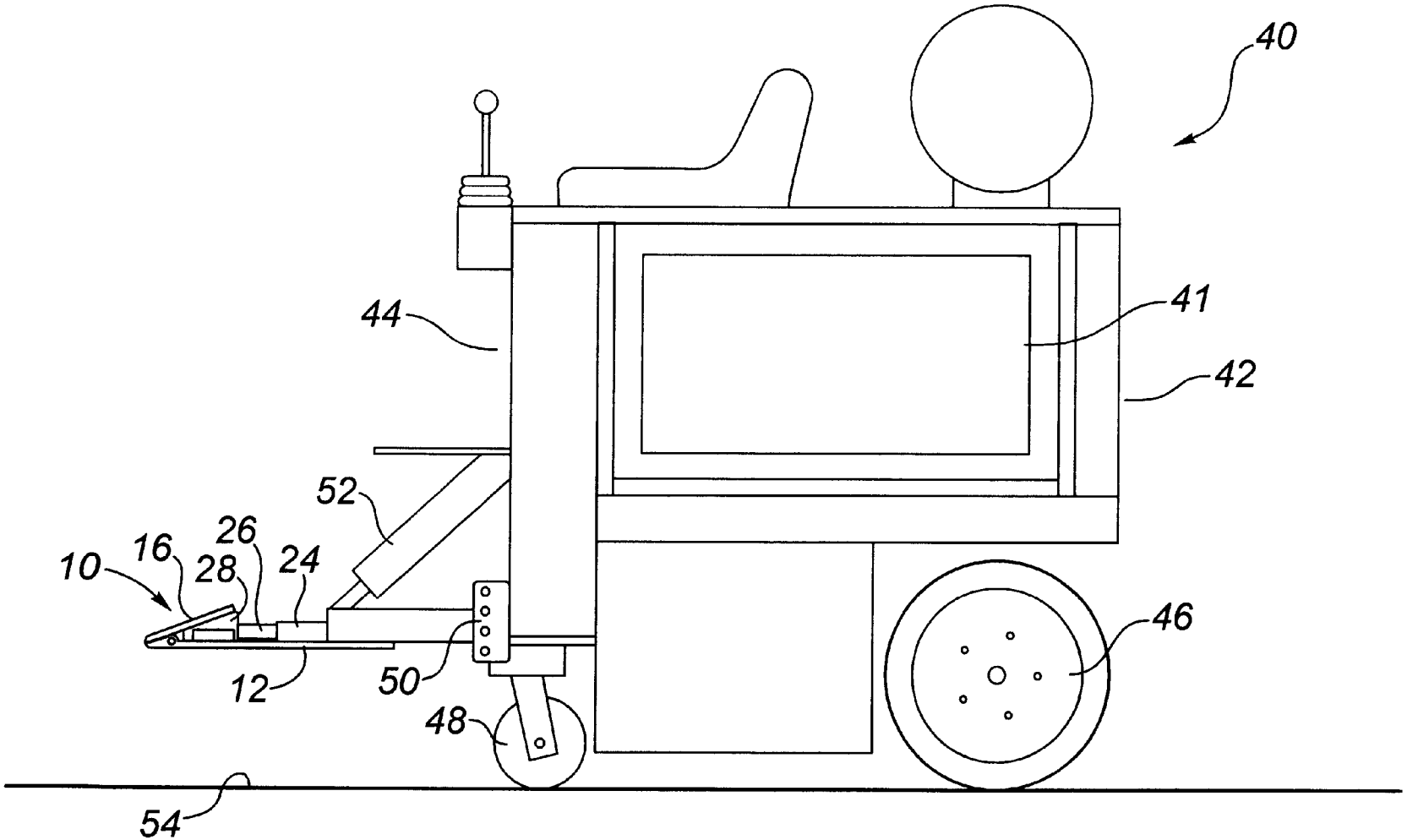
FIG. 7 is a side elevation view of a floor scraping machine equipped with the blade holder illustrated in FIG. 1, the blade holder being in a raised travel position.

Referring to FIGS. 6 and 7, a floor stripping machine, generally identified by reference numeral 40, has a body 41 with a first end 42 and a second end 44. A plurality of ground engaging wheels 46 support body 41 at first end 42. Ground engaging wheels 46 are drive wheels with which floor stripping machine 40 is propelled along the ground. Blade holder 10, as described above, is positioned at second end 44. A third wheel 48 is provided at first end 44 for steering floor stripping machine 40 when blade holder 10 is in a raised travel position illustrated in FIG. 7. A pivotal mounting bracket 50 is provided whereby first member 12 is pivotally mounted to second end 44 of body 41 for movement between the raised travel position illustrated in FIG. 7 and a lowered operative position illustrated in FIG. 6. A second telescopic actuator 52 that telescopically expands and contracts in response to fluid pressure is provided for pivotally moving blade holder 10 between the raised travelling position illustrated in FIG. 7 and the lowered operative position illustrated in FIG. 6.

The use and operation of blade holder 10 will now be described with reference to FIGS. 1 through 7. Floor stripping machine 40, as described above, is fitted with blade holder 10, as illustrated in FIG. 7. First actuator 22 is contracted to put blade holder 10 into the blade releasing position illustrated in FIGS. 1 and 4. Blade 20 is inserted into blade holder 10 as illustrated in FIG. 2. First actuator 22 is expanded so that head 28 urges second member 16 to pivotally move toward first member 12 thereby clamping blade 20 in position as illustrated in FIGS. 3 and 5. Floor stripping machine 40 is driven into a position at which a surface of floor 54 is to be stripped, while in the travelling position illustrated in FIG. 7. When floor stripping machine 40 is in the desired position, second actuator 52 is expanded so that blade 20 pivotally moves to engage surface of floor 54 to be stripped. Floor stripping machine 40 is then in the operative position illustrated in FIG. 6. When floor stripping machine 40 is in the operative position third wheel 48 is raised off the ground, causing a greater pressure to be applied by a front edge 56 of blade 20 on surface of floor 54 thereby improving the scraping action of blade 20. Blade 20 is manufactured from a material that is sufficiently flexible to allow blade 20 to reversibly curve into an optimal scraping attitude toward surface of floor 54, as illustrated in FIG. 6, but is sufficiently rigid to maintain contact of front edge 56 of blade 20 with said surface of floor 54 during use. Floor stripping machine 40 is driven forward along surface of floor 54 by power applied through ground engaging wheels 46. When an area of surface of floor 54 has been stripped, it is necessary to move floor stripping machine 40 to another location on surface of floor 54 to continue the stripping. Second actuator 52 is contracted thereby returning floor stripping machine 40 to the travelling position. Floor stripping machine 40 is then driven to the other location and the sequence of steps above is repeated until an entire area of surface of floor 54 has been stripped.

From time to time it is necessary to replace blade 20 when it is worn out or damaged through use. To enable replacement of blade 20, blade holder 10 on floor stripping machine 40 is put into the travelling position illustrated in FIG. 7. First actuator 22 is contracted to release the pressure exerted by head 28 enabling second member 16 to move pivotally away from first member 12, as illustrated in FIGS. 1 and 2. Worn out or damaged blade 20 is removed from blade holder 10 and is replaced by a replacement blade 20. First actuator 22 is then expanded so that head 28 urges second member 16 to pivotally move toward first member 12 thereby clamping blade 20 in position as illustrated in FIG. 3 as described above. Floor stripping machine 40 is then ready for further use.

When a small blade is used to increase the pressure exerted per square inch, it will be necessary from time to time to change the positioning of the small blade by moving it from a central position to the left or to the right. To reposition blade 20, blade holder 10 on floor stripping machine 40 is put into the travelling position illustrated in FIG. 7. First actuator 22 is contracted to release the pressure exerted by head 28 enabling second member 16 to move pivotally away from first member 12, as illustrated in FIGS. 1 and 2. Blade 20 is then reposition, as required. First actuator 22 is then expanded so that head 28 urges second member 16 to pivotally move toward first member 12 thereby clamping blade 20 in position as illustrated in FIG. 3 as described above.

It will be apparent to one skilled in the art that blade holder 10 enables blade 20 to be rapidly changed or repositioned. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A blade holder for a floor stripping machine, comprising:

a first member having a blade positioning seat;

a second member movable toward the blade positioning seat to a blade clamping position and away from the blade positioning seat to a blade releasing position, thereby permitting insertion or removal of a scraping blade; and the second member being moved between the blade clamping position and blade releasing position by a first actuator that telescopically expands and contracts in response to fluid pressure.

2. The blade holder as defined in claim 1, wherein the second member is pivotally secured to the first member, such that the second member is pivotally movable between the blade clamping position and the blade releasing position.

3. A blade holder for a floor stripping machine, comprising:

a first member having a blade positioning seat;

a second member pivotally secured to the first member and pivotally movable toward the blade positioning seat to a blade clamping position and away from the blade positioning seat to a blade releasing position, thereby permitting insertion or removal of a scraping blade; and a first telescopic hydraulic actuator for moving the second member between the blade clamping position and the blade releasing position, the first actuator telescopically expanding in response to pressure from hydraulic fluid to pivot the second member into the blade clamping position and contracting to permit the second member to pivot to the blade releasing position.

4. A floor stripping machine, comprising:

a body having a first end and a second end;

ground engaging wheels supporting the body at the first end;

a blade holder positioned at the second end, the blade holder including:

a first member having a blade positioning seat;

a second member pivotally secured to the first member and pivotally movable toward the blade positioning seat to a blade clamping position and away from the blade positioning seat to a blade releasing position, thereby permitting insertion or removal of a scraping blade; and a first telescopic hydraulic actuator for moving the second member between the blade clamping position and the blade releasing position, the first actuator telescopically expanding in response to pressure from hydraulic fluid to pivot the second member into the blade clamping position and contracting to permit the second member to pivot to the blade releasing position.

5. The floor stripping machine as defined in claim 4, wherein the first member has a pivotal mounting bracket whereby the first member is pivotally mounted to the second end of the body for movement between a raised travel position and a lowered operative position.

6. The blade holder as defined in claim 5, wherein the first member is moved between the travel position and the operative position by means of a second actuator that telescopically expands and contracts in response to fluid pressure.

* * * * *